United States Patent [19]

Norz

[11] Patent Number: 4,484,532

[45] Date of Patent: Nov. 27, 1984

[54] APPARATUS FOR BLIND STITCHING AN S-SHAPED HEM

[75] Inventor: Wolfgang Norz, Schwieberdingen, Fed. Rep. of Germany

[73] Assignee: Union Special G.m.b.H, Stuttgart, Fed. Rep. of Germany

[21] Appl. No.: 494,144

[22] Filed: May 12, 1983

[30] Foreign Application Priority Data

May 15, 1982 [DE] Fed. Rep. of Germany ..... 3218494

[51] Int. Cl.[3] ..... D05B 23/00; D05B 27/10

[52] U.S. Cl. ..... 112/2; 112/10; 112/121.26; 112/141; 112/322

[58] Field of Search ..... 112/121.26, 10, 2, 63, 112/121.29, 141, 143, 305, 322

[56] References Cited

U.S. PATENT DOCUMENTS

| | | | |
|---|---|---|---|
| 1,723,781 | 8/1929 | Hoggard | 112/121.26 |
| 3,783,805 | 1/1974 | Guichard | 112/121.26 X |
| 3,865,058 | 2/1975 | Rovin et al. | 112/10 X |
| 4,046,087 | 9/1977 | Manetti | 112/121.26 X |
| 4,191,117 | 3/1980 | Della Torre | 112/2 |

*Primary Examiner*—H. Hampton Hunter

*Attorney, Agent, or Firm*—John W. Harbst; John A. Schaerli

[57] ABSTRACT

An automatic sewing apparatus capable of blind stitching an S-shaped hem in the marginal edge of a tubular workpiece. The sewing apparatus is provided with a tensioning device including a pair of roller supports which arrange an open end of the workpiece in a closed loop formation. The roller support, arranged on the downstream side of the sewing machine, is provided with a guiding portion adapted to receive and controllably guide the sewn and hemmed edge of the tubular workpiece.

14 Claims, 3 Drawing Figures

APPARATUS FOR BLIND STITCHING AN S-SHAPED HEM

FIELD OF THE INVENTION

The present invention relates to sewing machines, and more particularly, to a sewing apparatus capable of blind stitching an S-shaped hem in the marginal edge of a tubular workpiece.

BACKGROUND OF THE INVENTION

Devices for sewing the edge of tubular workpieces are known in different forms of embodiments. An example of such is U.S. Ser. No. 372,366 filed Apr. 27, 1982. In that device, a support assembly and a positioning assembly cooperate in moving a workpiece edge to and through the sewing station of the machine. With such an apparatus, however, there is only a single turn of the workpiece edge. It is heretofore been difficult, without continuous operator interference, to automatically and mechanically perform the type of finish sewing operation wherein a looped or tubular article has the free end folded in an S-shaped fold and secured with an overedge stitch. The problem with such a sewing operation is enhanced because the needle may penetrate only one half of a ply of material being sewn. Moreover, when the hem has traversed substantially 360° of rotation, it must again be presented to the stitch forming instrumentalities with substantially the same lateral disposition as before or an imperfect seam will result. But, when the beginning of the sewn and hemmed seam again approaches the sewing machine, the transition, from the outstretched, to the folded and sewn edge of the material, causes the edge to proceed in an uncertain manner. In such operations, there is no assurance that the folded but unsewn edge will remain in its folded state. It may unfold under the tension provided by the tensioning apparatus. Because of this lack of control, faults in the seam occur at the end of the seam. To add to this already difficult situation, the control apparatus governing machine operation may error unless the workpiece edge is properly controlled. In summary, to automate this type of sewing operation has heretofore been a very difficult task to accomplish.

SUMMARY OF THE INVENTION

Because of the above, and in accordance with the present invention, there is provided an automatic sewing apparatus capable of blind stitching an S-shaped hem in the marginal edge of a tubular workpiece. With the apparatus according to this invention, continual intervention by the operater should no longer be required or necessitated.

The present invention includes an overedge sewing machine and workpiece support means disposed on opposite side of the machine's stitch forming instrumentalities. The support means serve to arrange the open end of the workpiece edge in a tensioned, closed loop configuration. The support means are adapted to concomitantly advance the workpiece edge through the machine in synchronized timed relation with the rate of workpiece advancement imparted by the feed mechanism of the machine.

The support means, on the downstream side of the sewing machine, is provided with a guiding portion. The guiding portion is adapted to receive and controllably guide the sewn and hemmed edge of the tubular workpiece as it exits the sewing machine. Preferably, the guide portion of the support is formed by two coaxial annular upstruck members having a channel or groove arranged therebetween. It is into this groove or channel that the sewn workpiece hem depends upon its emergence from the sewing machine. The hem depends into this channel because of the circumferential tension being applied on the workpiece by the work support means. One of the upstruck members is provided with an abutment flange extending radially outward from the bottom of the channel and against which the hem is controllably guided. The abutment flange is laterally disposed relative to the support means in the same vertical plane as that traversed by the needle. In this manner, the wall or flange forms a guiding surface which prevents the lateral movement of the workpiece edge toward the needle. Accordingly, and after substantially 360° of rotation, the beginning of the sewn hem is automatically again presented to the stitching point with substantially the same lateral disposition relative to the needle as when the hem exited the stitch forming instrumentalities thereby producing a satisfactory or acceptable blind stitch hem.

In line with the above, a primary object of this invention is to reduce the onus on an operator of a stitching machine in the above mentioned stitching operation.

Another object of this invention is to provide an automatic apparatus in which an S-shaped hem is formed in the edge of a tubular workpiece and is secured automatically, in a regular manner, without the operator having to intervene.

Another object of this invention is to provide an apparatus wherein a tubular article may be provided with a blind stitch hem in a fully automatic operation rather than by the customary manual operation.

Still a further object of this invention is to provide an apparatus wherein such a sewing operation can be preformed at high efficiency.

Yet a further object of this invention is to provide a method of sewing an S-shaped hem along the edge of a tubular article whereby the hem is rotated 360° and presented again to the sewing station with substantially the same lateral disposition as when that hem exited the stitch forming instrumentalities.

BRIEF DESCRIPTION OF THE DRAWINGS

Having in mind the above objects and other attendent advantages that would be evident from an understanding of this disclosure, the invention comprises the devices, combination, and arrangement of parts as illustrated in the presently preferred embodiment of the invention which are hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
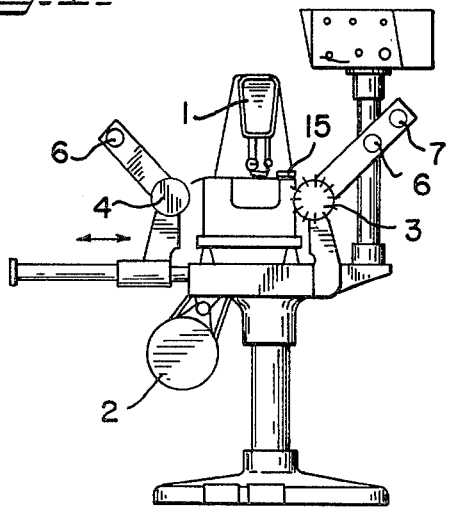
FIG. 1 is a schematic showing of the present invention.

Referring now to the drawings, wherein like reference numerals indicate like parts throughout the several views, there is shown in FIG. 1 a sewing machine 1, for instance a conventional chainstitch overedging machine. The machine 1 is supported on a work table or frame. Suffice it to say, the machine is provided with stitch forming instrumentalities including the usual reciprocatory needle means 14 driven towards and away from the stitch forming location, a presser foot, a work support means and a conventional feed mechanism for advancing the workpiece edge through the stitch forming location. The work table also supports a well known sewing machine drive motor 2 and control mechanism. As it's name implies, the control mechanism is adapted to govern the course of machine operation including machine deactivization, lifting of the presser foot and severing of the threads. Arranged immediately forward of the stitch forming location, in the direction of feed, is a hem former assembly or folder device 15 through which the workpiece edge passes on its way to the sewing machine. The folder device is adapted to arrange the workpiece edge into an S-shaped fold.

Arranged proximate the stitch forming location of the machine is a tensioning device. The tensioning device includes a pair of roller support means or cylinders 3 and 4. The roller support means are spaced apart, one on each side of the stitching location. The spacing being such that an open end of a tubular workpiece 11 to be hemmed may be trained over the rollers, with an ample space being provided therebetween to receive the necessary sewing machine and other associated mechanisms. One of the roller supports, i.e. roller 4 in the embodiment shown, is movable with respect to the other roller support such that the endless loop or annular formation of the workpiece edge may be subjected to a light tension. By this construction, the distance between the rollers and thus the peripheral tension on the workpiece edge is adapted to the particular diameter the circumferential cloth presently being sewn. The rotational axes of the roller support means are parallel and they are disposed in a plane extending substantially parallel to the work support surface of the machine. Moreover, the rotational axes of the rollers extend generally perpendicular to the workpiece advancing movement. Preferably, each of the roller support means are driven by a motor 6 at the sewing speed so as to impart a concomitant advancing motion to the open end or edge of the workpiece. In the preferred embodiment, a positioning element, driven by motor 7, operates in conjunction with the roller support means 3. The positioning element or assembly engages the workpiece adjacent one end thereof and is adapted to influence the positioning of the workpiece edge in a direction transverse or lateral to the feeding direction without affecting the feed in the sewing direction. For a more complete understanding of the construction and working of the roller assemblies and positioning element, the readers attention is directed to U.S. Ser. No. 372,366 filed Apr. 27, 1982; the full disclosure of which is incorporated herein by reference.

Figure 2:
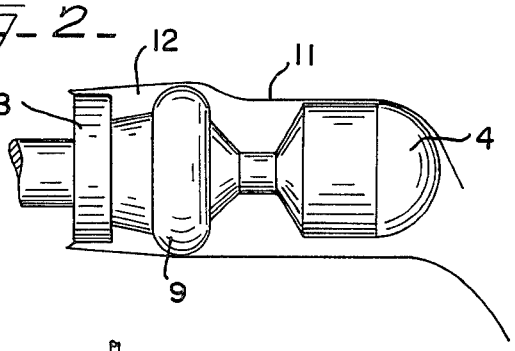
FIG. 2 is a schematic showing of the tubular workpiece arrangement prior to sewing.
Figure 3:
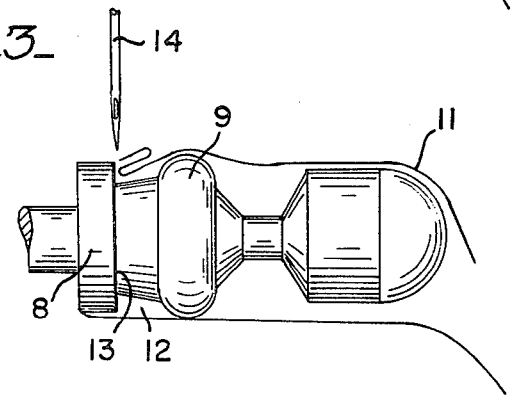
FIG. 3 is a schematic showing, similar to FIG. 2, but showing the orientation of the sewn hem and apparatus for maintaining such orientation.

As best seen in FIGS. 2 and 3, the support roller 4 includes a work engageable guide means at one end thereof. As will be subsequently described, the work engageable guide means cooperates with the tensioning of the workpiece edge in controlling the lateral disposition of the S-shaped hem or workpiece edge relative to the stitch forming instrumentalities. In the preferred embodiment, the work engageable guide means comprises two upstruck annular surfaces 8 and 9 having a groove or channel 12 disposed therebetween. The two upstruck surfaces are disposed a predetermined distance from the rollers inner end and are arranged coaxially with the support means. Preferably, the periphery of surface 9 defines a rounded rim which, amongst other things, enhances the drawing in of the folded edge of the workpiece into the groove or channel 12. Depending from the upstruck annular surface 8 is an abutment flange 13 serving to guide the hem sewn into the workpiece. The abutment flange or wall 13 extends radially outward from the channel's bottom, substantially perpendicular to the axis of rotation of the support roller 4. Moreover, the guiding surface of the abutment flange is disposed a predetermined distance from the desirous path of the workpiece edge and is in vertical alignment with the reciprocal path of the needle means 14. In this manner, the wall 13 forms a stop which prevents the lateral movement of the workpiece edge toward the needle.

To carry out a hem folding operation by means of the apparatus as described, a tubular article is arranged such that its open end is trained about the roller support means 3 and 4. The workpiece edge is initially positioned, by the operator, as shown in FIG. 2 over both upstruck surfaces 8 and 9. The support roller 4 is thereafter caused to controllably move away from the stitch forming zone. The workpiece edge is thereby placed under a controlled amount of circumferential tension. Next, the workpiece edge is advanced through the hemmer 15 toward the stitch forming instrumentalities. Accordingly, the marginal portion or edge of the article changes into a curved or S-shaped configuration. As seen in FIG. 3, the workpiece edge's curved configuration is formed by a triple thickness fold. Then, when the sewing operation is commenced, the edge is sewn and the upper edge is trimmed to form the hem shown in FIG. 3. The edge continues to be folded mechanically and automatically during the sewing operation. As the sewn hem exits the stitch forming zone and as it approaches the roller support means 4, the hem in drawn into the channel or groove 12 as a result of the circumferential tension being applied to the workpiece by the roller support means 3 and 4. Thereafter, the triple thickness of material comprising the S-shaped hem workpiece edge is guided by the abutment flange 13. In this manner, and after substantially 360° rotation, the sewn hem is presented to the stitching point or location in substantially the same lateral disposition relative to the needle means as when the hem exited the stitch forming instrumentalities thus producing a satisfactorily formed blind stitch seam.

Thus, there has been provided an Apparatus For Blind Stitching An S-Shaped Hem that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described my invention, what I claim is:

1. A sewing apparatus capable of securing an S-shaped fold in the advancing edge of a tubular workpiece with an overedge stitch, said sewing apparatus comprising:

an overedge sewing machine having stitch forming instrumentalities;

a hemmer capable of forming an S-shaped fold in the edge of a workpiece; and a tensioning device for arranging one end of the workpiece in a tubular configuration, said tensioning device includes at least two rollers one of which is designed as a guide roller having a channel adapted to receive and guide the sewn workpiece edge.

2. The sewing apparatus of claim 1 wherein said channel is formed between two annular upstruck surfaces coaxially arranged on said guide roller.

3. The sewing apparatus of claim 1 wherein said rollers rotate upon an axis extending generally perpendicular to the workpiece advancing movement, and said guide roller is provided with an edge guiding surface extending generally perpendicular to the axis of rotation of said rollers.

4. An automatic apparatus for forming and sewing a hem in the marginal portion of a tubular article, said apparatus comprising:

a sewing machine having stitch forming instrumentalities including vertically reciprocal needle means adapted to secure an S-shaped fold in the edge of a tubular article;

means disposed in advanced of the sewing machine in such a manner to form an S-shaped fold in the unsewn edge of the tubular article; and at least one rotatable support means disposed on each side of said stitch forming instrumentalities for carrying the edge of said workpiece in a closed loop configuration, the support means arranged on the downstream side of said stitch forming instrumentality being provided with a guiding portion operable to control the lateral disposition of the hemmed workpiece edge.

5. The automatic apparatus of claim 4 wherein said guide portion is formed with two annular upstruck surfaces arranged on said support means.

6. The automatic apparatus of claim 4 wherein said support means rotate upon an axis extending generally perpendicular to the workpiece advance movement and said guide portion is provided with an edge guiding surface extending generally perpendicular to the axis of rotation of said support means.

7. The automatic apparatus of claim 6 wherein said guiding surface is disposed in the same vertical plane as that traversed by the vertical reciprocal needle means.

8. A sewing machine apparatus comprising:

a sewing machine having stitch forming instrumentalities capable of securing an S-shaped fold in the advancing edge of a tubular article;

support means arranged on opposite sides of said sewing machine and adapted to present the S-shaped fold formed in the edge of the tubular article to said sewing machine in a position for said fold to be secured by said sewing machine, said support means being adapted to support a portion of said tubular article in a tubular configuration with said support means extending within said tubular article, wherein the support means arranged on the downstream side of said sewing machine being provided with a guiding portion for controlling the lateral disposition of the article's sewn and hemmed edge.

9. The sewing machine apparatus according to claim 8 wherein said guiding portion includes two annular upstruck surfaces with the channel formed therebetween for the reception and guidance of the sewn and hemmed workpiece edge.

10. In a sewing machine having stitch forming instrumentalities for working along an S-shaped fold formed in the advancing edge of a tubular workpiece, the combination of an apparatus comprising:

a frame including means for rotatably mounting at least two cylinder means on opposite sides of said stitch forming instrumentalities such that the open end of said tubular workpiece is supported in a closed loop configuration; and the cylinder means arranged on the downstream side of said sewing machine further acting as a hem guide means adapted to receive and guide the sewn and hemmed edge of the tubular workpiece.

11. The invention according to claim 10 wherein the hem guide means includes two upstruck annular surfaces coaxially arranged with respect to and supported by said cylinder means in an area proximate the path of travel of the sewn and hemmed workpiece edge.

12. In combination with a sewing machine having a work support means, stitch forming instrumentalities for securing an S-shaped fold in the edge of a tubular workpiece and means for advancing the workpiece past said sewing instrumentalities, an apparatus comprising:

at least two cylinder means for supporting and tensioning the tubular workpiece edge;

means for mounting the cylinders rotatably on either side of the stitch forming instrumentalities in a generally horizontal position with its rotational axis extending generally perpendicular to the direction of workpiece advancement;

means for rotating at least one of said cylinders in synchronization with the advancement of the workpiece;

means for controlling the lateral disposition of the S-shaped hem as it approaches the stitch forming instrumentalities; and means adapted to cooperate with said cylinder means for controlling the lateral disposition of the S-shaped hem as it exits the stitch forming instrumentalities.

13. In combination with the sewing machine having means for performing a stitching operation along the edge of the tubular workpiece, folder means for creating an S-shaped hem in edge of the workpiece, an apparatus comprising:

at least two workpiece support means for carrying said workpiece in a closed loop configuration;

means for positioning the open end of said tubularly configured workpiece relative to said folder means; and guide means for controlling the disposition of the sewn workpiece edge relative to the means for performing a stitching operation.

14. An apparatus for hemming tubular flexible workpieces comprising:

a sewing machine having a frame and stitch forming means adapted to operate along a lineraly advancing workpiece edge;

at least one hemmer through which the workpiece edge passes on its way to the sewing machine;

a tensioning device including two rollers disposed on opposite sides of the stitch forming means for axially receiving and suppporting each workpiece to be peripherally hemmed; and work engagable guide means cooperating with the tensioning device for controlling the lateral disposition of the hemmed workpiece edge.

* * * * *

UNITED STATES PATENT AND TRADEMARK OFFICE

CERTIFICATE OF CORRECTION

PATENT NO. : 4,884,532

DATED : December 5, 1989

INVENTOR(S) : Cheng TAN et al

It is certified that error appears in the above-identified patent and that said Letters Patent is hereby corrected as shown below:

Claim 1, line 4, after "a" insert -- head (4c), -- and "bid" should be -- big --.

Signed and Sealed this

Twelfth Day of February, 1991

*Attest:*

HARRY F. MANBECK, JR.

*Attesting Officer*

*Commissioner of Patents and Trademarks*